US006746535B2

(12) United States Patent
Hasenour et al.

(10) Patent No.: US 6,746,535 B2
(45) Date of Patent: Jun. 8, 2004

(54) APPARATUS FOR SPRAY COATING A CONTINUOUSLY ADVANCING ARTICLE

(75) Inventors: Benjamin W. Hasenour, St. Anthony, IN (US); John R. Stenftenagel, Huntingburg, IN (US); James F. Arvin, Jasper, IN (US)

(73) Assignee: Dubois Equipment Company, Inc., Jasper, IN (US)

( * ) Notice: Subject to any disclaimer, the term of this patent is extended or adjusted under 35 U.S.C. 154(b) by 0 days.

(21) Appl. No.: 10/262,119

(22) Filed: Oct. 1, 2002

(65) Prior Publication Data

US 2003/0183166 A1 Oct. 2, 2003

Related U.S. Application Data

(63) Continuation-in-part of application No. 10/109,482, filed on Mar. 28, 2002, now abandoned.

(51) Int. Cl.[7] ..... B05B 7/06; B05B 15/12

(52) U.S. Cl. ..... 118/313; 118/314; 118/323; 118/324; 118/309; 118/326

(58) Field of Search ..... 118/313, 314, 118/321, 323, 324, 322, 315, 316, 308, 309, 326

(56) References Cited

U.S. PATENT DOCUMENTS 4,241,646 A * 12/1980 Tsuruta et al. ..... 454/52
5,669,974 A * 9/1997 Cueller et al. ..... 118/686

* cited by examiner

*Primary Examiner*—Richard Crispino
*Assistant Examiner*—Yewebdar Tadesse
(74) *Attorney, Agent, or Firm*—John R. Hoffman

(57) ABSTRACT

An apparatus is provided for coating a continuously advancing article. The apparatus includes a housing defining a spray chamber having an inlet end and an outlet end. Walls in the spray chamber form an inlet buffer zone adjacent the inlet end, an outlet buffer zone adjacent the outlet end and a spraying zone between the inlet and outlet buffer zones. A conveyor transports articles to be coated through the spray chamber. A plurality of spray guns are mounted on the housing to substantially surround an article on the conveyor transported through the spraying zone. The spray guns are adapted for spraying an ultraviolet curable coating composition. The spray guns are mounted substantially entirely outside the spraying zone, with only nozzle portions of the spray guns located inside the spraying zone.

25 Claims, 9 Drawing Sheets

APPARATUS FOR SPRAY COATING A CONTINUOUSLY ADVANCING ARTICLE

RELATED APPLICATION

This is a continuation-in-part of application Ser. No. 10/109,482 which was filed Mar. 28, 2002 now abandoned.

FIELD OF THE INVENTION

This invention generally relates to an apparatus for coating articles or parts and, particularly, to an apparatus for spray coating continuously advancing articles in an enclosed atmosphere.

BACKGROUND OF THE INVENTION

Generally, it is known to spray paint or coat articles by an apparatus having a conveyor which moves parts to and through some form of spraying booth where one or more nozzles coat the articles with a coating composition. These apparatus or systems are limited by the amount of volatile organic compounds that the sprayed coatings emit, the amount of floor space required to cure the coatings and by limited transfer efficiency.

For instance, the paint or coating composition, itself, creates considerable problems. If the composition uses components which are dispersed in various solvents or dilutents, the solvents or dilutents not only present the potential for explosion, but the amount of volatile organic components that can be emitted are highly regulated by governmental agencies. Water-based coatings may be used with less volatile organic components, but other complications such as the raising of wood grains must be overcome. Both solvent and water based coatings require long flash times to allow the solvents or dilutents to evaporate. This requires a considerable amount of floor space. In addition, these solvents or dilutents must be evacuated to atmosphere. Replacing the evacuated air is expensive, especially in colder climates or where buildings must be air conditioned.

In order to avoid the problems described above, ultraviolet (UV) curable coating compositions have been used. A 100% solids UV curable composition is a liquid composition and is void of solvents or dilutents which must be driven off in a curing or drying process. A UV composition cures only when exposed to ultraviolet light. In essence, a UV composition changes state from liquid to solid upon curing and there is no weight change between the two states. Unfortunately, UV compositions present their own set of problems of non-uniform coating thickness and an unnatural "plastic" look on wood articles. Such UV coatings also are difficult to apply to three-dimensional or contoured articles, particularly where the articles have leading and trailing edges to be coated. Prior apparatus have been designed to continuously advance articles through the apparatus while cyclically traversing the spray nozzles generally perpendicular to the movement of the articles. While such techniques may apply a more uniform coating on contoured articles, they create considerable problems in partially overlapped patterns which create transverse "strips" of varying thickness. Roll coating processes can be used, but roll coating is limited to flat articles and cannot be used with three-dimensional articles such as contoured cabinet doors. Vacuum coating processes can be used, but such processes are limited to continuous profile articles such as moldings and cannot be used with articles having leading and trailing edges such as contoured cabinet doors. The terms "leading" and "trailing" edges of an article not only mean the first or front edge and the last or rear edge, respectively, of an article. Some articles, such as cabinet doors, have inside profiles which form depressed or recessed areas of the article between the front and rear edges of the article. These recessed areas form leading and trailing edges which extend transverse to the direction of movement of the article through the coating apparatus. A sphere is comprised almost entirely of a leading (hemispherical) edge and a trailing (hemispherical) edge.

A major problem with such coating apparatus is their inability to apply a thin-enough coating using 100% solids UV curable compositions on such articles as wood products to obtain a desired natural finish. This often is called a "plastic" look. This occurs because the spray nozzles are limited in their translatory speed. Since no solvents evaporate in 100% solids UV curable compositions, in order to obtain the same dry thickness, a much thinner coating must be applied. Some prior art systems have compromised in adding a solvent to dilute the UV composition. However, this solvent must be removed from the coating before it is cured, resulting in the above problems of volatile organic compounds, long flash tunnels, etc.

Still another problem with prior apparatus is the limited recovery of overspray. Systems that use solvent-based or water-based coating compositions typically are able to recover little or no overspray.

Systems that use UV coating compositions that are diluted with solvent are able to capture material deposited on the conveyor belt, but are able to respray the recovered coating only after more solvent is added to the composition. No known systems are able to collect both the overspray and material deposited on the belt and to respray the recovered coating without reformation.

The present invention is directed to solving this myriad of sometimes interrelated problems in a coating apparatus which incorporates a number of features which, in combination, produces an extremely high quality coating and even an unexpected finish on difficult articles to be coated.

SUMMARY OF THE INVENTION

An object, therefore, of the invention is to provide a new and improved apparatus for coating a continuously advancing article.

In the exemplary embodiment of the invention, the apparatus includes a housing defining a spray chamber having an inlet end and an outlet end. Wall means form an inlet buffer zone adjacent the inlet end and an outlet buffer zone adjacent the outlet end, with a spraying zone between the inlet and outlet buffer zones. Conveying means are provided for transporting articles to be coated through the spray chamber from the inlet to the outlet ends thereof. A plurality of spray guns are mounted on the housing in an array about the spraying zone to substantially surround an article on the conveying means transported through the spray chamber. The spray guns are adapted for spraying up to a 100% solids ultraviolet curable coating composition. Substantially the entirety of the spray guns are located outside the spray chamber, with only nozzle portions of the spray guns located inside the spray chamber, thereby reducing the size of the spraying zone.

As disclosed herein, the housing includes a cover defining the top of the spraying zone. The spray guns are mounted on the cover, and power means may be provided for raising and lowering the cover. The wall means which form the inlet and outer buffer zones with the spraying zone therebetween, comprise walls which extend downwardly from the cover to points short of the conveying means to allow the articles to pass beneath the walls. Drip troughs are provided at the bottom edges of the walls to prevent any coating composition accumulating thereon from dripping downwardly therefrom.

According to one aspect of the invention, the housing defines a center-line extending between the inlet and outlet ends and generally equidistant from opposite sides of the spray chamber. A plurality of the spray guns are mounted on each opposite side of the center-line, with the spray guns oriented to spray the spraying composition angularly inwardly relative to the center-line.

In addition, the housing defines a mid-point spaced between the inlet and outlet ends, and a plurality of the spray guns are mounted on each opposite side of the mid-point in directions toward and away from the inlet and outlet ends. The spray guns are oriented to spray the spraying composition angularly inwardly relative to the mid-point.

The conveying means may be provided by an endless conveyor belt having an upper run or surface which forms the bottom of the spray chamber. The conveyor belt can be moved at a relatively fast speed of 50–300 feet/minute to provide varying thicknesses of the coating composition.

With the spray guns located substantially entirely outside the spray chamber, the spray guns have extension portions projecting through the top of the cover to locate nozzle portions of the spray guns within the spray chamber. The nozzle portions are located approximately 8–30 inches from an article transported beneath the nozzle portions by the conveyor.

Finally, exhaust means are provided in communication with the spray chamber. The invention contemplates that the exhaust means be in communication with the buffer zones at opposite ends of the spraying zone within the spray chamber. In addition, a controlled amount of air is allowed to be exhausted from the spraying zone.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
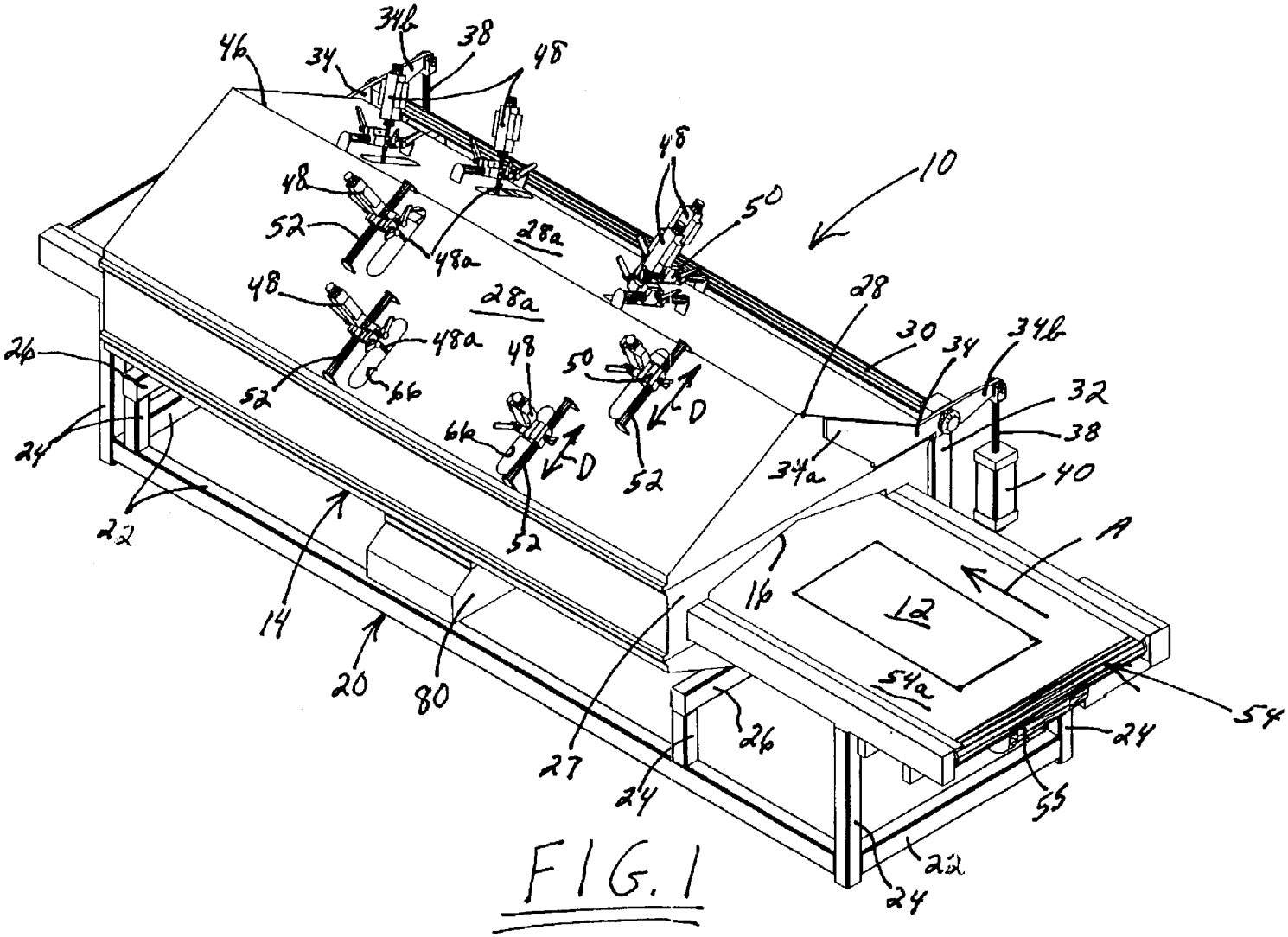
FIG. 1 is a top perspective view of a coating apparatus incorporating the concepts of the invention.

Referring to the drawings in greater detail, and first to FIGS. 1–4, the invention is embodied in an apparatus, generally designated 10, for coating continuously advancing articles 12 (FIG. 1) which are advanced through the apparatus in the direction of arrow "A". The apparatus includes a housing, generally designated 14, which defines a spray chamber (described hereinafter) having an inlet end 16 and outlet end 18. The housing is substantially fabricated of stainless steel sheet metal material. The housing is mounted on top of a supporting framework, generally designated 20. The supporting framework includes a plurality of floor braces 22, a plurality of support posts 24 projecting upwardly from the floor braces, and a plurality of cross braces 26 for supporting housing 14 thereon.

Housing 14 includes end walls 27 and a cover 28 which is mounted by a pivot shaft 30 to a pair of upright support posts 32 at the rear of the apparatus. A pair of levers 34 are fixed to opposite ends of the pivot shaft. Inner ends 34*a* of the lever are fixed, as by welding, to the opposite ends of cover 28. Outer ends 34*b* of the levers are pivotally connected, as at 36, to the distal ends of a pair of pistons 38 of a pair of piston and cylinder devices 40 which are pivotally connected, as at 42 (FIG. 3), to a pair of brackets 44 fixed to the bottoms of upright support posts 32. As seen best in FIG. 3, when piston 38 is retracted into piston and cylinder device 40 in the direction of arrow "B", cover 28 is lifted upwardly in the direction of arrow "C" about pivot shaft 30. The cover is lowered in the opposite direction by extending piston 38.

Cover 28 is a triangulated structure which has upwardly and inwardly angled top walls 28*a* which join at an apex 46 defining a center-line which extends in a direction between inlet end 16 and outlet end 18 of the housing. The top walls are at an angle of approximately 25–30 degrees to allow spray composition to flow down the walls. A plurality of spray guns 48 are mounted to the outside of cover 28 by a plurality of clamps 50 which are respectively, releasably clamped to a plurality of adjustment bars 52 fixed to the outside of top walls 28*a* of the cover. The clamps actually engage extension pipes 48*a* of the spray guns. The clamps allow the spray guns to be adjusted along adjustment bars 52 in the direction of double-headed arrows "D" (FIG. 1), which is transversely of the advancing movement "A" of the articles to be coated.

A conveying means, generally designated 54, transports articles 12 through the spray chamber defined by housing 14 from the inlet to the outlet ends 16 and 18, respectively. The conveying means is provided herein by an endless conveyor belt having an upper run or surface 54*a* which, in essence, forms the bottom of the spray chamber as indicated by dotted line 54*a* in FIG. 2. The conveyor can be run as fast as 50–300 fpm, with the system of the invention still being very effective. An electric motor 55 operates the conveyor belt by rotating a drive shaft 55*a* for the belt. Other types of conveying means such as an overhead hanging line or conveyor can be used.

Figure 3:
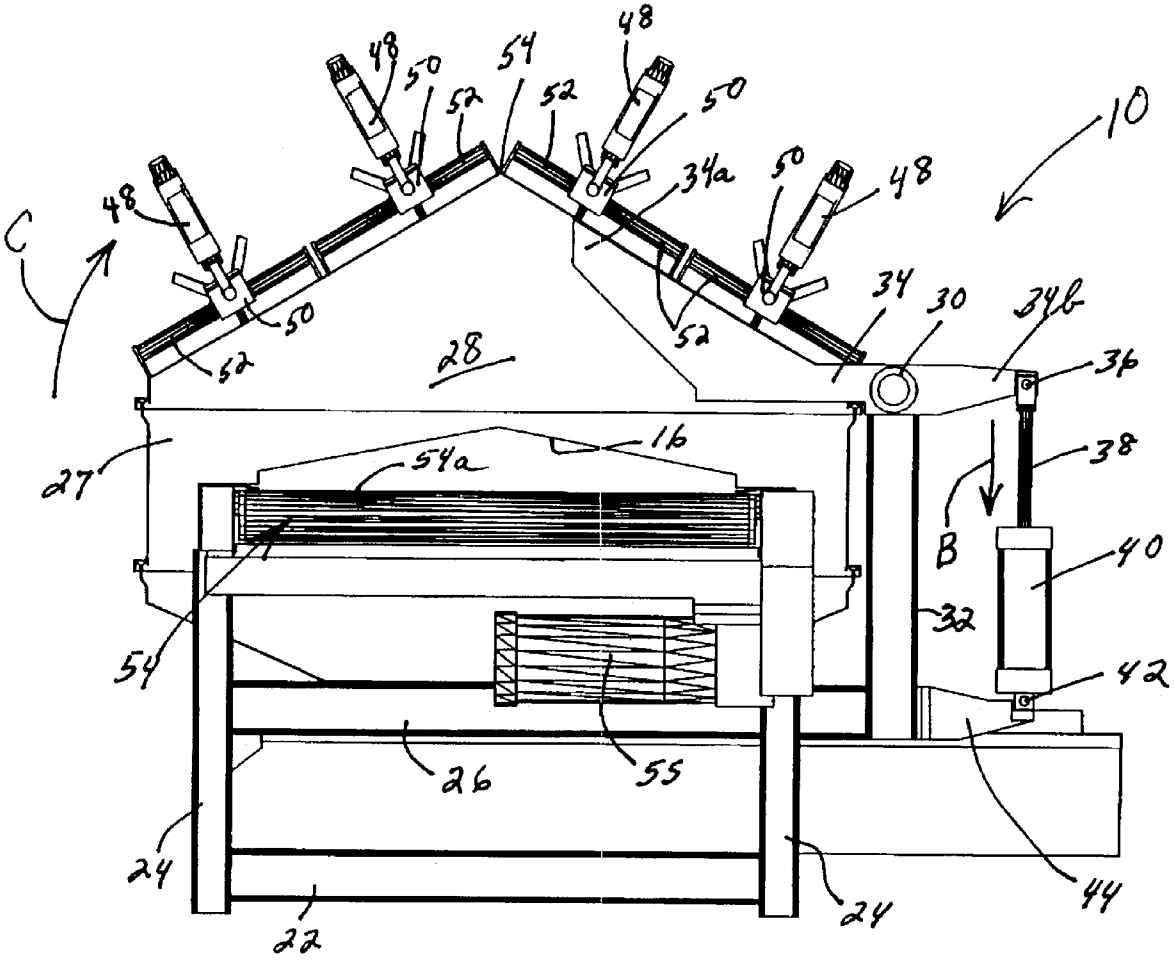
FIG. 3 is an end elevational view of the apparatus, looking toward the right-hand ends of FIGS. 1 and 2.
Figure 4:
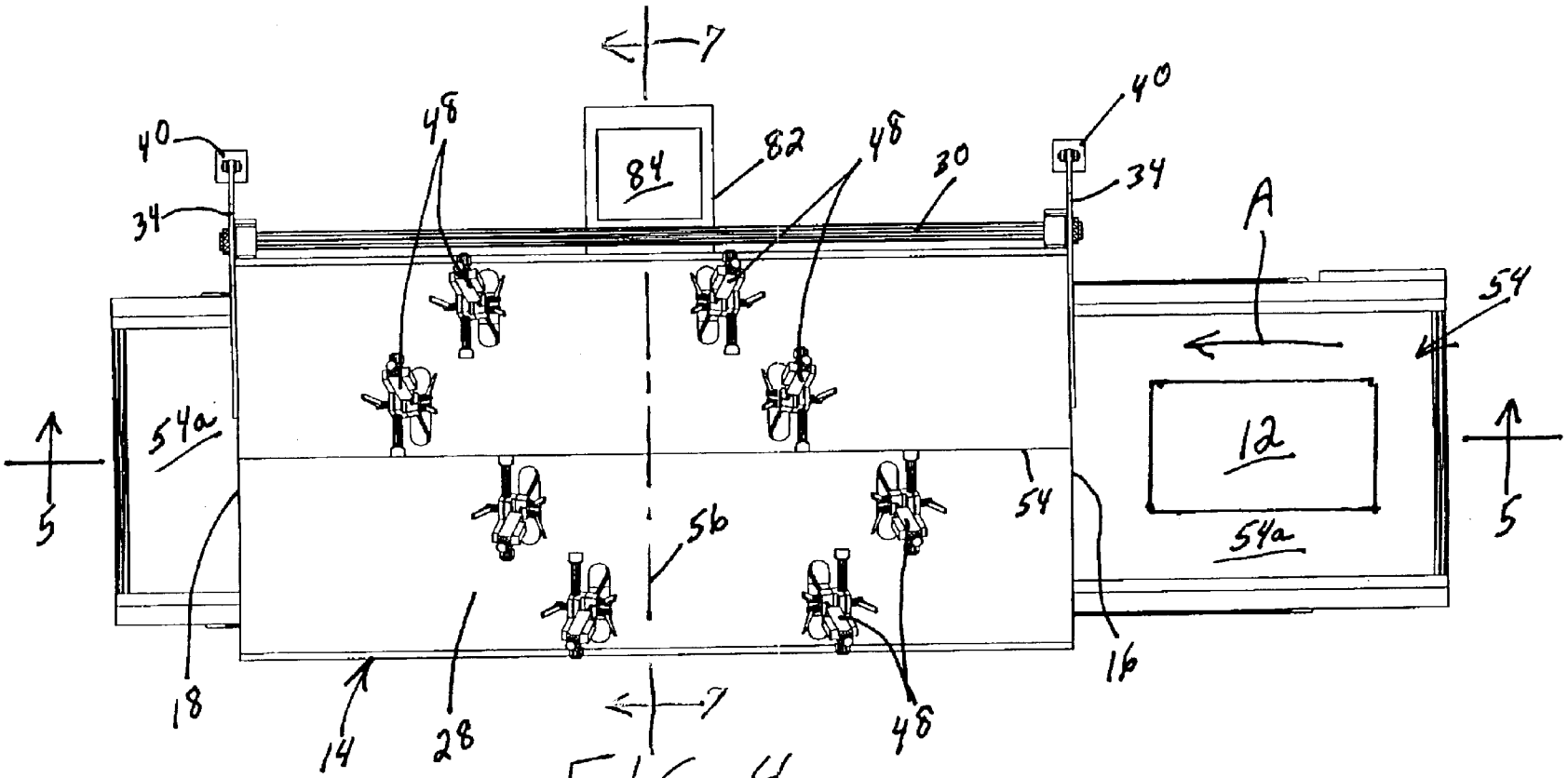
FIG. 4 is a top plan view of the apparatus.
Figure 5:
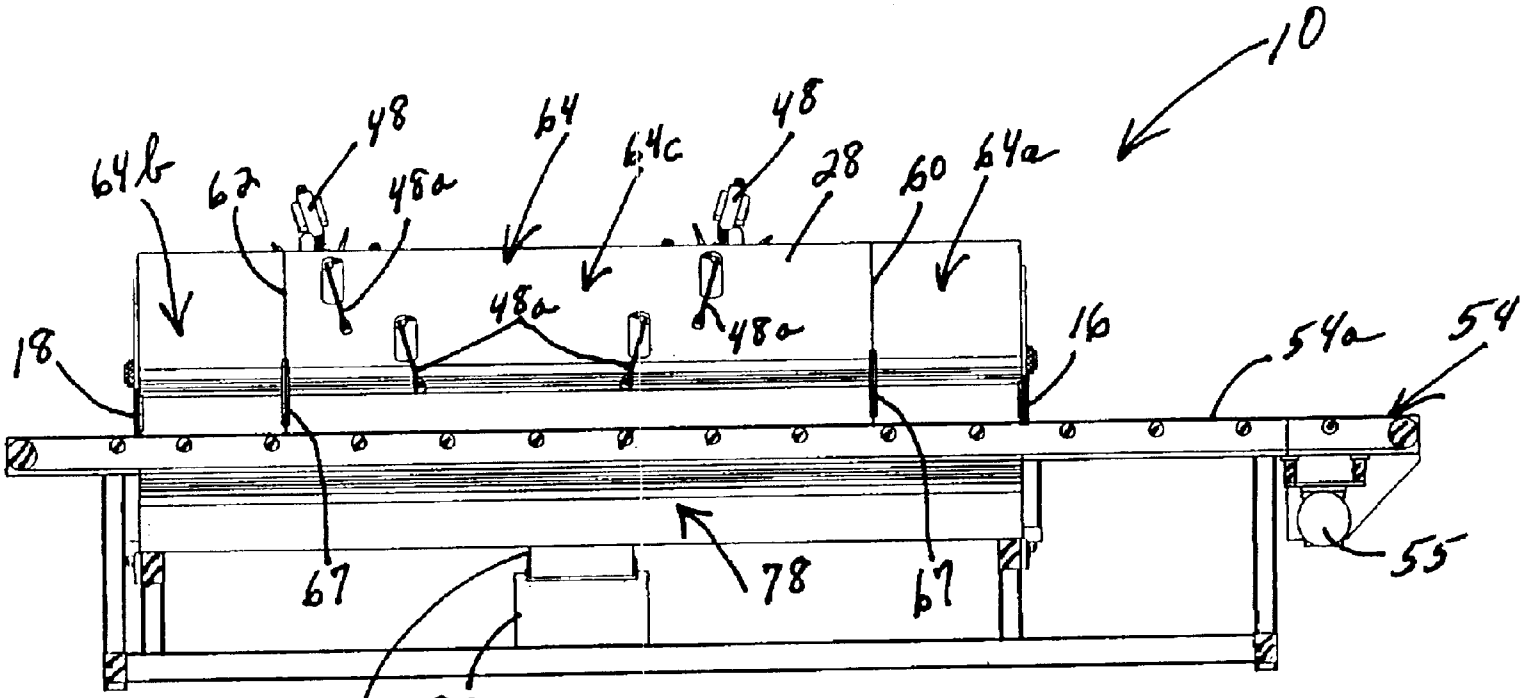
FIG. 5 is a vertical section taken generally along line 5—5 of FIG. 4.

Looking at the top plan view of FIG. 4, a phantom line 56 represents a mid-point which is spaced between inlet end 16 and outlet end 18 of housing 14. It can be seen that a plurality of spray guns 48 are located on each opposite side of mid-point 56 in directions toward and away from the inlet and outlet ends. As seen best in FIG. 2, the spray guns are angled inwardly relative to mid-point 56. In addition, a plurality of spray guns 48 are located on each opposite side of center-line 54. As best seen in FIG. 3, the spray guns are angled inwardly relative to the center-line.

Figure 2:
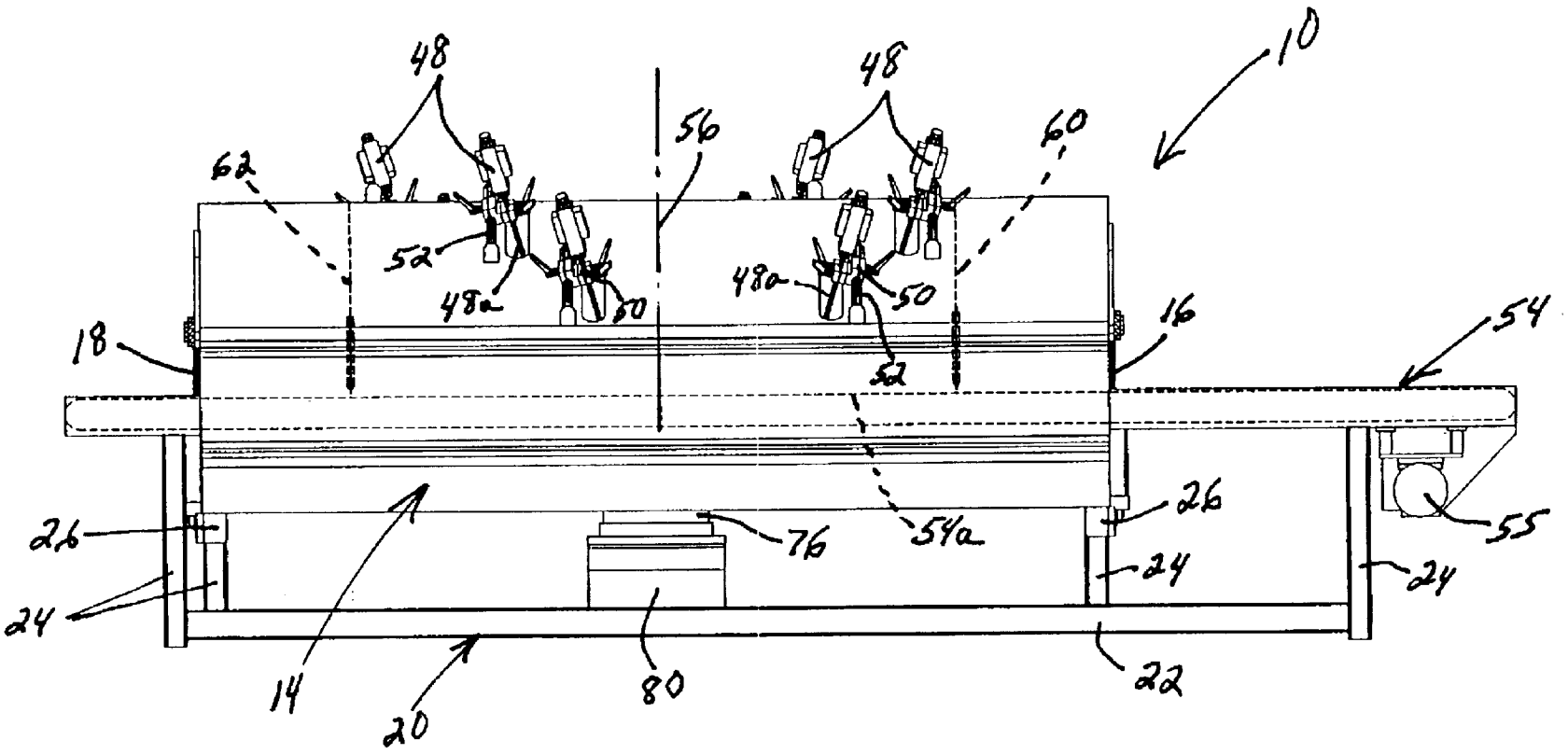
FIG. 2 is a side elevational view of the apparatus.

Referring to FIGS. 5–8 particularly in conjunction with FIG. 2, a pair of walls or partitions 60 and 62 extend downwardly from the inside of cover 28 to points short of top surface 54*a* of the conveyor to allow articles 12 to pass beneath the walls. In essence, end walls 27, cover 28 and surface 54*a* of the conveyor belt form a spray chamber, generally designated 64, within the housing of the apparatus. Wall or partition 60 defines an inlet buffer zone, generally designated 64*a*, of spray chamber 64 adjacent inlet end 16. Wall or partition 62 defines an outlet buffer zone, generally designated 64*b*, of spray chamber 64 adjacent outlet end 18. Both walls or partitions 60 and 62 define a spraying zone, generally designated 64*c*, of spray chamber 64 between the inlet and outlet buffer zones 64*a* and 64*b*, respectively. Spray guns 48 are mounted to cover 28 so that extension pipes 48*a* extend through holes 66 in the cover and into spraying zone 64*c* of spray chamber 64. The walls or partitions 60 and 62 have drip troughs 67 along their bottom edges to prevent any coating composition accumulating on the walls from dripping onto the coated articles. Holes 66 are enlarged to allow some air to be drawn into the spray chamber to keep the spraying mist away from the nozzles of the spray guns as described below. This prevents droplets from forming on the nozzles. However, the incoming air does not interfere with the spray misting pattern itself.

Figure 6:
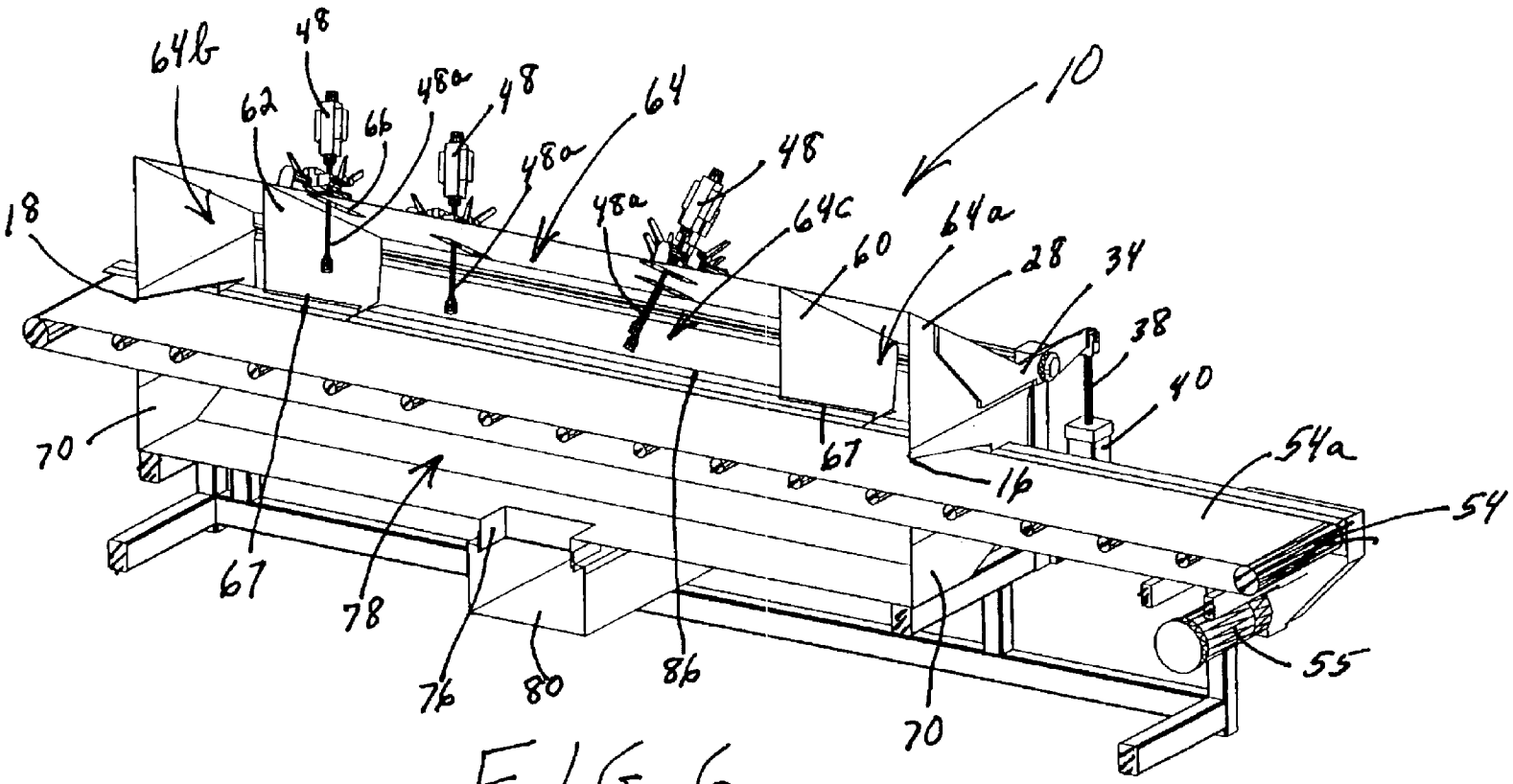
FIG. 6 is a perspective view looking at the sectional depiction of FIG. 5.
Figure 7:
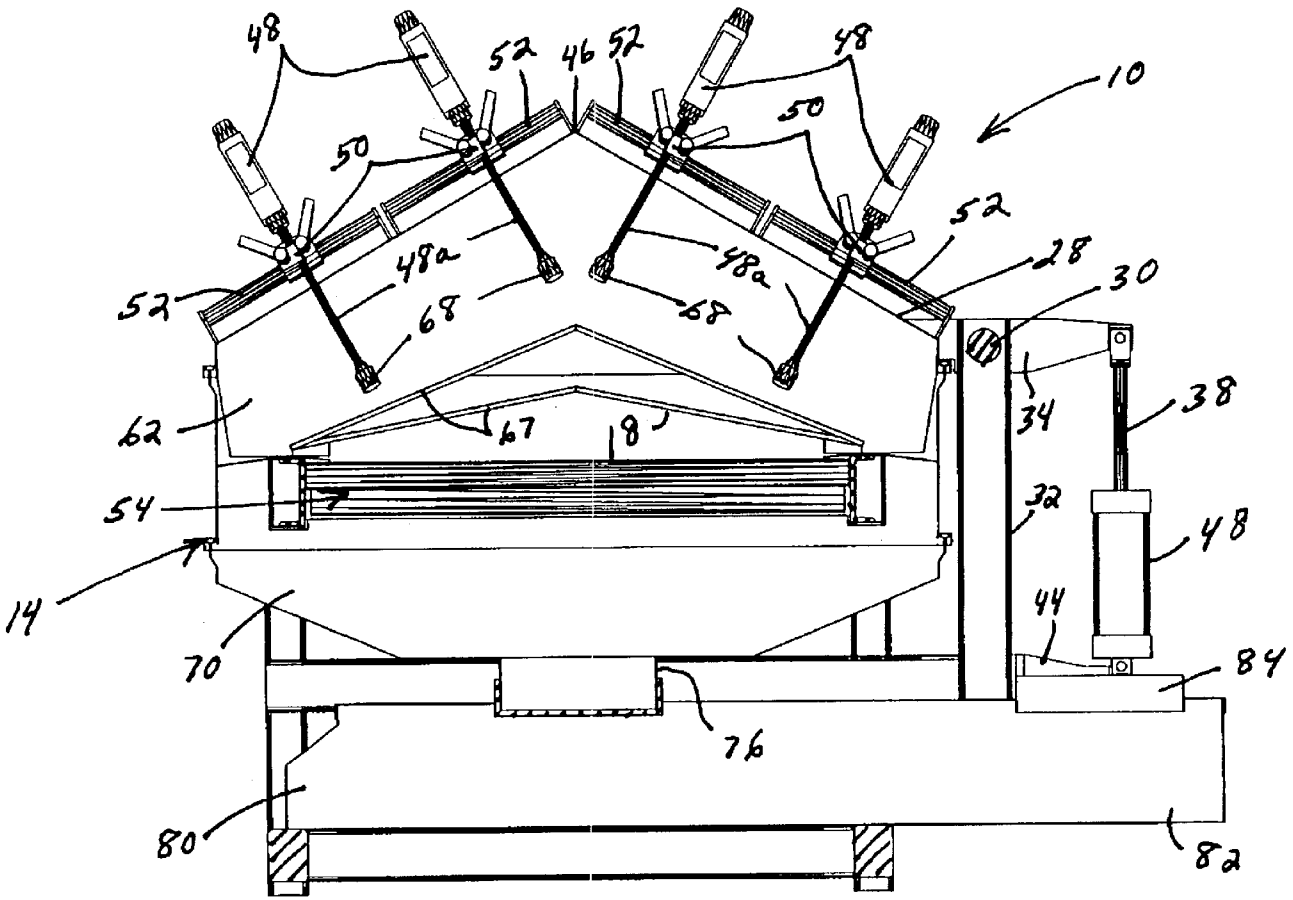
FIG. 7 is a vertical section taken generally along line 7—7 of FIG. 4.
Figure 8:
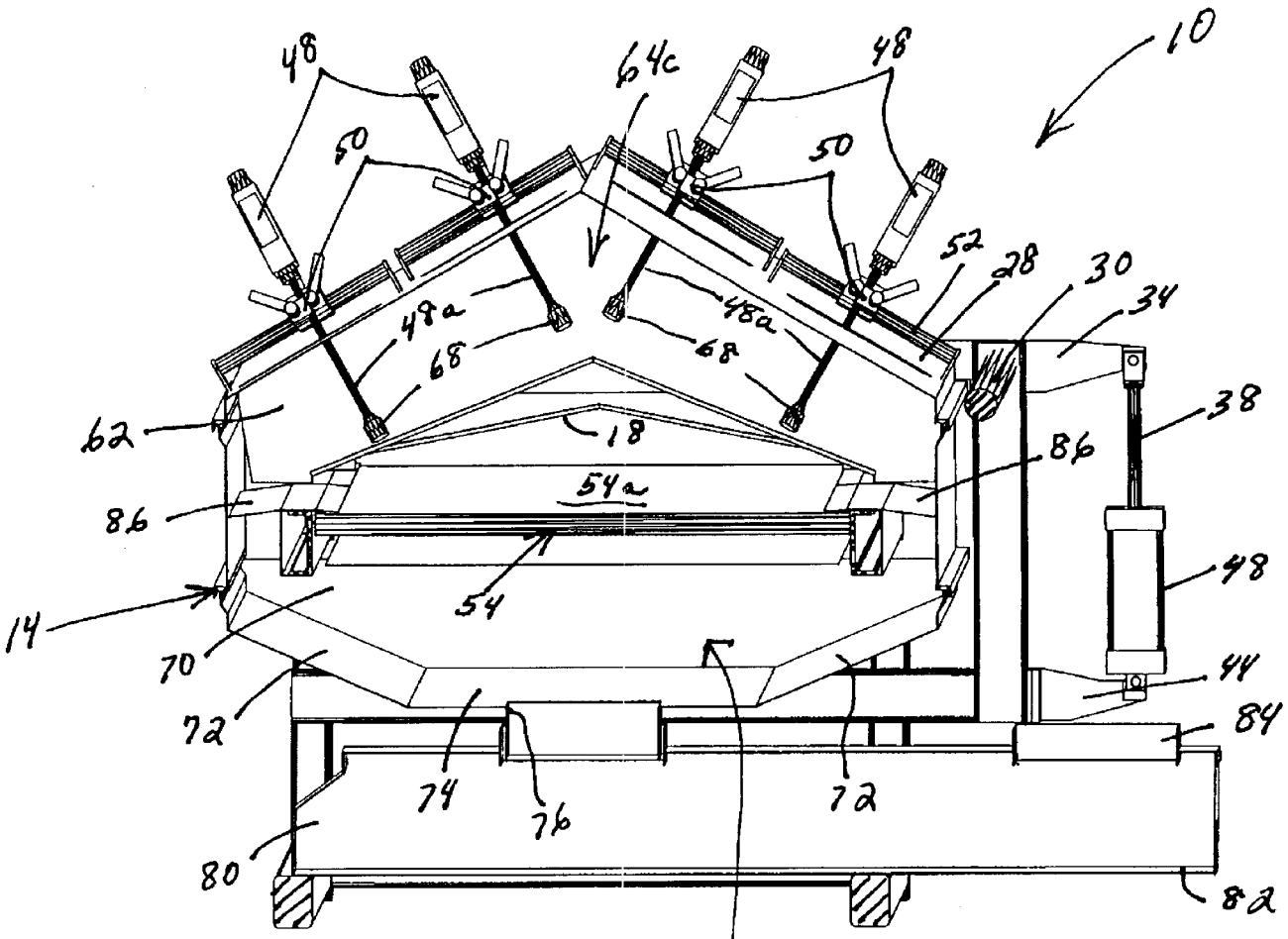
FIG. 8 is a perspective view of the sectional depiction of FIG. 7.

As best seen in FIGS. 6–8, each spray gun 48 has a nozzle assembly 68 at the distal end of the extension pipe 48*a* of the respective spray gun. Nozzle assemblies 68 include a nozzle and an "air cap" which adjusts the configuration of the actual spray. Spray guns 48 are of a type which are capable of spraying up to a 100% solids ultraviolet (UV) curable coating composition. The characteristics of UV curable compositions are described in the "Background" above. The spray guns preferably are air spray guns which can be used with UV curable compositions, although air-assisted or airless spray guns might be used. Supply lines for the air and the UV curable composition have been omitted from the drawings in order to avoid cluttering the depictions. Nevertheless, as can be seen clearly in FIGS. 6–8, by locating substantially the entirety of the spray guns 48, themselves, completely outside the housing and completely outside spraying zone 64*c*, only nozzle assemblies 68 at the distal ends of extension pipes 48*a* are located within the spraying zone. This allows the spray chamber, and particularly the spraying zone, to be of a significantly small size or volume. The nozzles of the spray guns can be located 8–30 inches from the articles to be coated.

As best seen in FIGS. 6–8, the base of housing 14 includes opposite end walls 70 and angled bottom walls 72 leading to a substantially flat bottom wall 74. Bottom wall 74 may be inclined slightly toward the center of the apparatus and to a drain 76. Walls 70, 72 and 74 define an exhaust chamber, generally designated 78, below conveyor 54. A reservoir 80 is located below and in communication with drain 76. An exhaust pipe 82 leads from reservoir 80 to an evacuation means 84 which may be a variety of means providing a vacuum to exhaust chamber 78. Excess coating composition drops downwardly into exhaust chamber 78 and eventually through drain 76 into reservoir 80 which can be recycled entirely to the spray guns.

Figure 9:
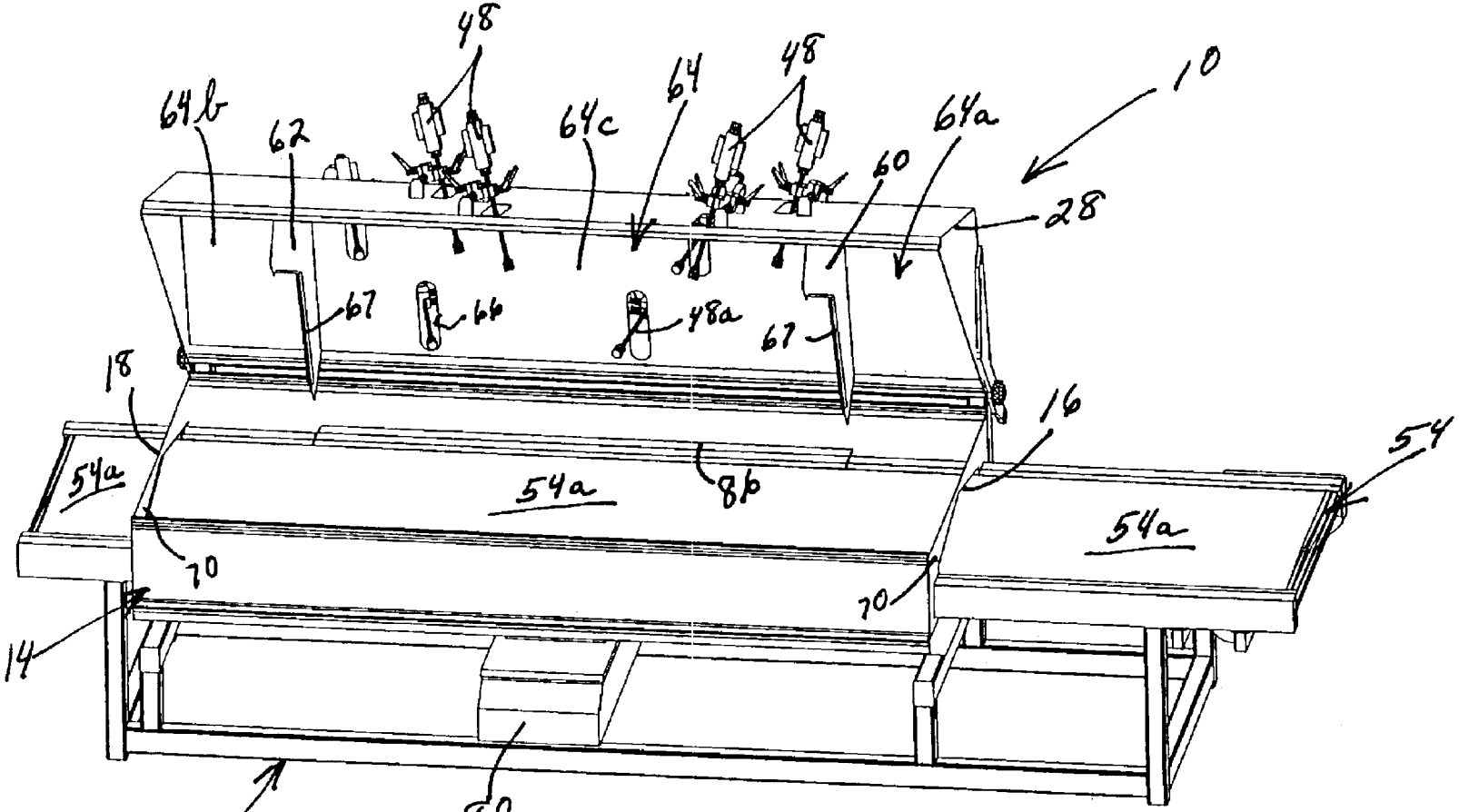
FIG. 9 is a perspective view looking into the interior of the apparatus, with the cover elevated.

Referring to FIG. 9 in conjunction with FIGS. 6 and 8, it can be seen that a pair of adjustable blocking panels or barriers 86 are provided lengthwise along the outside edges of conveyor 54 along the extent of spraying zone 64*c* of spray chamber 64. However, it should be noted that no such barriers are provided outside the conveyor within buffer zones 64*a* and 64*b*. Therefore, when evacuation means 84 evacuates exhaust chamber 78 beneath conveyor 54, some air is directed from spray chamber 64 downwardly only in the end buffer zones. With walls 60 and 62 forming barriers between the buffer zones and spraying zone 64, the exhausting air does not significantly interfere with the atmosphere within spraying zone 64*c*. A considerable amount of air is drawn into the buffer zones from atmosphere through inlet and outlet ends 16 and 18, respectively, of the housing. This prevents any air-borne spray particles from escaping the spray chamber. On the other hand, it is contemplated that blocking panels 86 can be adjustably mounted by an appropriate interference fit to provide a variable gap between the panels and the inside walls of housing 14. In other words, a controlled gap could be provided along one or both of the blocking panels longitudinally of spraying zone 64 to allow a controlled amount of air to be exhausted from the spray chamber.

From the foregoing, it can be understood that apparatus 10 includes a number of features which combine to provide an overall coating system. This system has been proven in actual practice to provide a superior coating on such articles as wood cabinet doors and the like which have three-dimensional or contoured configurations including contoured leading and trailing edges. Articles of other materials, such as plastics, can be coated by the system of the invention. The system begins with the use of a superior UV curable composition which avoids many of the problems identified in the "Background", above, with solvent or water-based compositions. The system uses a unique configuration of a spray chamber with its distinct buffer zones and spraying zone. The system uses a unique nozzle arrangement, including mounting the spray guns outside the spray chamber so that the spraying zone can be reduced in size and volume. This allows the nozzles, themselves, of the spray guns to be located relatively close to the articles to be coated. In addition to the spray chamber configuration and the nozzle arrangement, the exhaust system of the apparatus is quite unique and provides limited disturbances within the spraying zone of the spray chamber. All of these features taken individually or in an interrelated combination provide what can be called a "directional turbulence" within the spraying chamber which practically eliminates the problems of uneven coating, overlapping or "banding". Still further, these various features allow the conveying means to move articles through the spray chamber at a relatively fast speed, ranging from 50–300 fpm, compared to the prior art with slower speeds of 35 fpm or less, and eliminates the undesirable "plastic" look on wood products. The system of the invention can be used quite effectively with UV curable compositions with 60%–100% solids, whereas most prior art systems for three-dimensional products cannot approach 100% solids UV curable spraying compositions.

It should be understood that the use of the terms UV curable composition herein and in the claims hereof are not intended to eliminate compositions that can be cured by electron beam curing processes. Specifically, a UV curing apparatus incorporates a photo initiator, whereas an electron beam curing apparatus excites the coating without the initiator. Preferably, the system herein uses a "UV curable composition" which is a generic term herein and is meant to include compositions that can be cured either by a UV curing apparatus, an electron beam curing apparatus, a laser beam curing apparatus or the like. Generically, this is considered radiation curing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An apparatus for coating a continuously advancing article, comprising:

a housing defining a spray chamber having an inlet end and an outlet end, wall means within the spray chamber forming an inlet buffer zone adjacent the inlet end, wall means within the spray chamber forming an outlet buffer zone adjacent the outlet end, with a spraying zone between and separate from the inlet and outlet buffer zones whereby the respective wall means form barriers between the spraying zone and the respective inlet and outlet buffer zones;

conveying means for transporting articles to be coated through the spray chamber from the inlet to the outlet ends thereof; and a plurality of spray guns mounted on the housing in an array about the spraying zone to substantially surround an article on the conveying means transported through the spray chamber, the spray guns being adapted for spraying up to a 100% solids ultraviolet curable coating composition, substantially the entirety of the spray guns being located outside the spray chamber with substantially only nozzle portions of the spray guns being located inside the spray chamber thereby reducing the size of the spraying zone.

2. The apparatus of claim 1 wherein said housing includes a cover defining the top of the spraying zone.

3. The apparatus of claim 2 wherein said spray guns are mounted on the cover.

4. The apparatus of claim 2, including power means for raising and lowering said cover.

5. The apparatus of claim 1 wherein said housing defines a center-line extending in a direction between said inlet end and said outlet end and generally equidistant from opposite sides of the spray chamber, and including a plurality of said spray guns mounted on each opposite side of the center-line.

6. The apparatus of claim 5 wherein said spray guns are oriented to spray the spraying composition angularly inwardly relative to the center-line.

7. The apparatus of claim 1 wherein said housing defines a mid-point spaced between said inlet end and said outlet end, and including a plurality of said spray guns mounted on each opposite side of the mid-point in directions toward the inlet and outlet ends.

8. The apparatus of claim 7 wherein said spray guns are oriented to spray the spraying composition angularly inwardly relative to the mid-point.

9. The apparatus of claim 1 wherein said conveying means comprises an endless conveyor belt having an upper run forming the bottom of the spray chamber.

10. The apparatus of claim 1 wherein said wall means comprise walls extending downwardly from a top of the spray chamber to points short of the conveying means to allow the articles to pass beneath the walls.

11. The apparatus of claim 10 wherein said walls have drip troughs near bottom edges thereof to prevent any coating composition accumulating on the walls from dripping downwardly therefrom.

12. The apparatus of claim 1 wherein said spray guns have extension portions projecting through a top of the spray chamber to locate nozzle portions of the spray guns within the spray chamber.

13. The apparatus of claim 12 where said nozzle portions are located approximately 8 to 30 inches from an article transported beneath the nozzle portions by said conveying means.

14. The apparatus of claim 1, including exhaust means communicating with said spray chamber.

15. The apparatus of claim 14 wherein said exhaust means is in communication with only the buffer zones at opposite ends of the spraying zone within the spray chamber.

16. An apparatus for coating a continuously advancing article, comprising:

a housing defining a spray chamber having an inlet end and an outlet end, a plurality of walls extending downwardly from a top of the spray chamber to points allowing articles to pass therebeneath, the walls dividing the spray chamber into an inlet buffer zone adjacent the inlet end, an outlet buffer zone adjacent the outlet end and a spraying zone between and separate from the inlet and outlet buffer zones whereby the respective walls form barriers between the spraying zone and the respective inlet and outlet buffer zones;

conveying means for transporting articles to be coated through the spray chamber from the inlet to the outlet ends thereof;

a plurality of spray guns mounted on the housing in an array about the spraying zone to spray an article on the conveying means transported through the spray chamber, the spray guns being adapted for spraying up to a 100% ultraviolet solids curable coating composition; and exhaust means in communication with only the buffer zones at opposite ends of the spraying zone within the spray chamber.

17. The apparatus of claim 16 wherein said housing includes a cover defining the top of the spraying zone.

18. The apparatus of claim 17 wherein said spray guns are mounted on the cover.

19. The apparatus of claim 16 wherein said conveying means comprises an endless conveyor belt having an upper run forming the bottom of the spray chamber.

20. The apparatus of claim 16 wherein said walls have drip troughs near bottom edges thereof to prevent any coating composition accumulating on the walls from dripping downwardly therefrom.

21. The apparatus of claim 16 wherein said spray guns have extension portions projecting through a top of the spray chamber to locate only nozzle portions of the spray guns within the spray chamber.

22. The apparatus of claim 21 where said nozzle portions are located approximately 8 to 30 inches from an article transported beneath the nozzle portions by said conveying means.

23. The apparatus of claim 16, including means for adjusting the positions of the spray guns transversely of the direction of movement of the advancing articles.

24. The apparatus of claim 16, including means for adjusting the positions of the spray guns toward and away from the conveying means.

25. The apparatus of claim 24, including means for adjusting the positions of the spray guns transversely of the direction of movement of the advancing articles.

* * * * *